US009322265B2

(12) United States Patent
Kong

(10) Patent No.: US 9,322,265 B2
(45) Date of Patent: Apr. 26, 2016

(54) SEDIMENT CORING APPARATUS FOR PREVENTING LOSS AND DISTURBANCE OF SAMPLE IN CORE

(71) Applicant: Korea Institute of Geoscience and Mineral Resources, Daejeon (KR)

(72) Inventor: Gee Soo Kong, Daejeon (KR)

(73) Assignee: Korea Institute of Geoscience and Mineral Resources, Daejeon (KR)

( * ) Notice: Subject to any disclaimer, the term of this patent is extended or adjusted under 35 U.S.C. 154(b) by 344 days.

(21) Appl. No.: 13/916,903

(22) Filed: Jun. 13, 2013

(65) Prior Publication Data

US 2014/0158434 A1 Jun. 12, 2014

(30) Foreign Application Priority Data

Jun. 14, 2012 (KR) ..... 10-2012-0063580

(51) Int. Cl.
*E21B 25/18* (2006.01)
*E21B 49/02* (2006.01)

(52) U.S. Cl.
CPC ..... *E21B 49/025* (2013.01); *E21B 25/18* (2013.01)

(58) Field of Classification Search
CPC ..... E21B 10/02; E21B 10/605; E21B 25/02; E21B 25/18; E21B 49/025
See application file for complete search history.

(56) References Cited

U.S. PATENT DOCUMENTS 3,066,748 A * 12/1962 Doherty ..... E21B 25/02 166/155

FOREIGN PATENT DOCUMENTS

KR 101029693 B1 4/2011

* cited by examiner

*Primary Examiner* — Cathleen Hutchins
(74) *Attorney, Agent, or Firm* — The Webb Law Firm

(57) ABSTRACT

Provided is a coring apparatus for collecting marine sediments, and more particularly, to a coring apparatus having a core filled with marine sediments when the coring apparatus is inserted into a seabed.

4 Claims, 3 Drawing Sheets

SEDIMENT CORING APPARATUS FOR PREVENTING LOSS AND DISTURBANCE OF SAMPLE IN CORE

CROSS-REFERENCE TO RELATED APPLICATIONS

This application claims priority under 35 U.S.C. §119 to Korean Patent Application No. 10-2012-0063580, filed on Jun. 14, 2012, in the Korean Intellectual Property Office, the disclosure of which is incorporated herein by reference in its entirety.

TECHNICAL FIELD

The present invention relates to a coring apparatus for collecting marine sediments, and more particularly, to a coring apparatus having a core filled with marine sediments when the coring apparatus is inserted into a seabed.

BACKGROUND

For various research and experiments for geoscience and mineral resources, there is a need to collect samples. To this end, various types of sample collecting apparatuses and coring apparatuses have been proposed.

Describing in detail, since marine sediments have well preserved information in respect to a global environment change over a long period of time, the marine sediments have been utilized as palaeoecological research data and important research data for tracing and developing seabed mineral resources (manganese nodules, phosphoanhydrite, marine sand, and the like) and energy sources (oil, gas, gas hydrate, and the like).

Further, the marine sediments provide important research data about seabed geologic storage, and the like. Such information may be used to reduce pollution or dioxide carbon at a coastal area which has a direct relationship on human activities.

As described above, collecting samples of marine sediments is one process essential for research and development. To this end, various types of apparatuses for collecting marine sediments have been proposed.

There is a coring apparatus having the core filled with the marine sediments when the core is inserted into the seabed. The core is disposed in an external tube having a pipe form, such as a piston corer, a gravity corer, a multi corer, and the like, in the apparatus for collecting marine sediments.

However, in prior art devices, the marine sediments filled in the core are excessively disturbed or flow down from the core. As a result, the marine sediments are lost during pulling up of the coring apparatus to a ship after the coring apparatus performs the coring operation. Therefore, the coring operation itself becomes unproductive.

In particular, when the coring operation is performed in soft ground, the loss of the marine sediments frequently occurs in the core and, as a result, data may not be obtained through the coring operation.

That is, the marine sediments need to be retained in the core intact without the loss of the marine sediments from the core and without disturbance, such as the mixing of the marine sediments. In such fashion, highly reliable data may be obtained through the samples of the marine sediments.

In order to prevent the samples in the core from being lost and disturbed during the pulling up of the coring apparatus, as disclosed in Korean Patent No. 1029693, the coring apparatus in which a top portion of the core can be sealed.

However, the related art as described above is a technology of moving upwardly the piston disposed in the core by a pressure generated during the process of filling the marine sediments in the core. This occurs when the external pipe and the core of the coring apparatus are inserted into the seabed and a packing is disposed at the outside of the piston to prevent a gap from being formed between the packing and the core.

Therefore, when the packing is removed or a pressure is applied to the piston while the piston moves upwardly, the piston does not move smoothly, and the operation of the piston is not as efficient.

SUMMARY

An exemplary embodiment of the present invention is directed to providing a coring apparatus capable of preventing a loss and a disturbance of marine sediments in a core during a pulling up of the coring apparatus after the coring apparatus performs a coring operation, without applying pressure to the marine sediments introduced into the core.

In one general aspect, when a core is pulled up after a coring operation, a screw disposed over the core rotates by a force pulling up the core to move a stopper and allow the stopper to seal a top portion of the core, thereby preventing a loss or a disturbance of marine sediments in the core.

The coring apparatus may have an external tube that may be inserted into a seabed for performing a coring operation.

The core may be disposed in the external tube and have the marine sediments filled from a bottom portion thereof by being inserted into the seabed at the same time when the external tube is inserted into the seabed.

The coring apparatus may have a stopper disposed in a top portion of the core to seal the top portion of the core.

The coring apparatus has a screw disposed over the core. The screw is rotated by moving upwardly the external tube and the core from the seabed.

The coring apparatus may have a stopper moving part having a stopper moving shaft which connects the screw with the stopper. The stopper moving part moves the stopper downwardly with respect to the core in response to the rotation of the screw when the external tube and the core are pulled up, thereby sealing the top portion of the core.

DETAILED DESCRIPTION OF EMBODIMENTS

Figure 1:
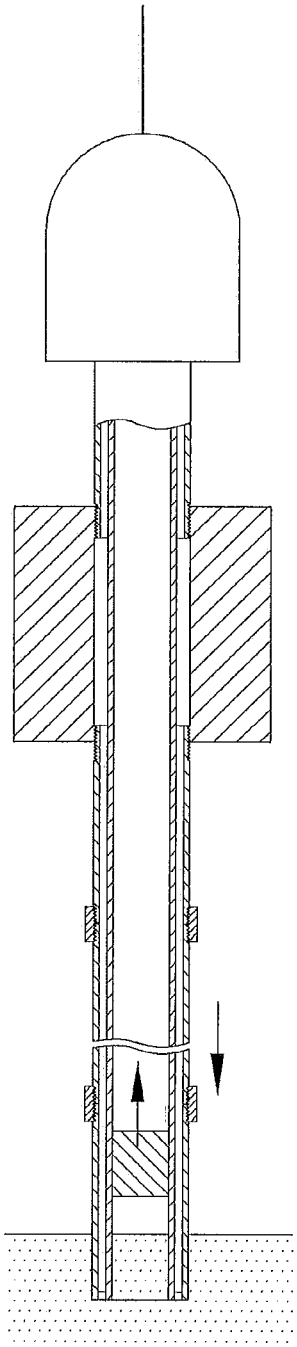
Fig. 1 Prior Art
FIG. 1 is a diagram schematically illustrating a state in which an external tube and a core are inserted into a seabed and a piston moves upwardly, during a coring operation of the seabed by a coring apparatus having a core according to the prior art.
Figure 2:
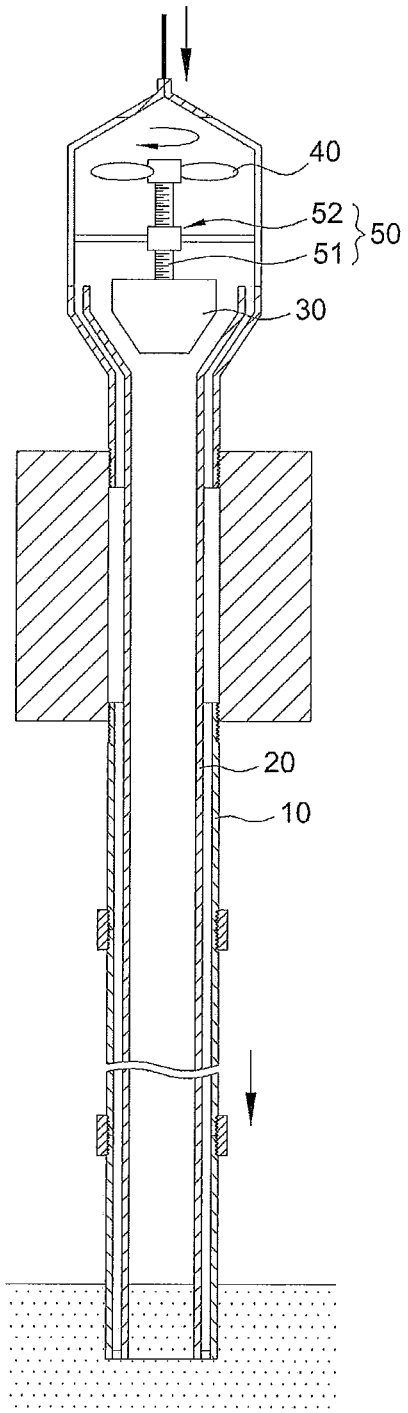
FIG. 2 is a diagram schematically illustrating a state in which a coring apparatus according to an exemplary embodiment of the present invention is unsealed and not capable of preventing a loss and a disturbance of samples in a core inserted into a seabed.
Figure 3:
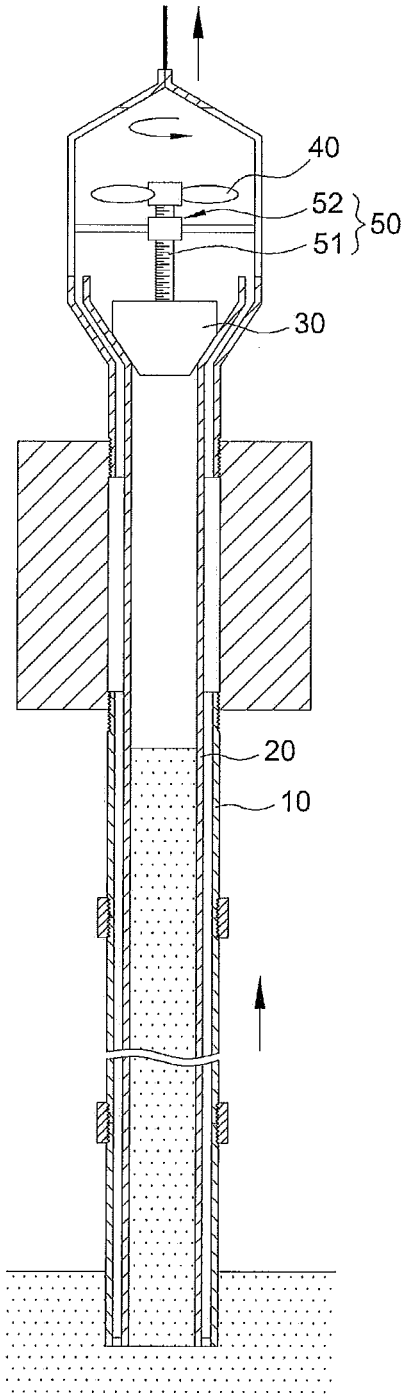
FIG. 3 is a diagram schematically illustrating a state in which the coring apparatus according to an exemplary embodiment of the present invention is sealed and capable of preventing the loss and the disturbance of the samples as the core is pulled from the seabed up to a ship.

Hereinafter, the present invention will be described in more detail with reference to the accompanying drawings.

However, the accompanying drawings are only examples shown in order to describe the technical idea of the present invention in more detail. Therefore, the scope of the present invention is not limited to embodiments of the accompanying drawings.

The present invention relates to a coring apparatus having a core 20 filled with marine sediments.

Therefore, the coring apparatus according to an exemplary embodiment of the present invention has an external tube 10 inserted into a seabed for performing a coring operation.

Further, the coring apparatus has the core 20 disposed in the external tube 10 and with the marine sediments filled from a bottom portion. The core 20 is filled by being inserted into the seabed at the same time the external tube 10 is inserted into the seabed.

However, the exemplary embodiment of the present invention is to provide the coring apparatus the capability to prevent a loss or a disturbance of the marine sediments in the core during a pulling up of the coring apparatus after the coring apparatus performs a coring operation.

According to the exemplary embodiment of the present invention, a top portion of the core 20 is sealed to prevent the loss or the disturbance of the marine sediments in the core 20 during the pulling up of the coring apparatus after the coring apparatus performs the coring operation. (This is the same as a principle of sealing a top portion of a spoid to prevent a liquid in the spoid from pouring down).

Therefore, the coring apparatus according to the exemplary embodiment of the present invention includes a stopper 30 which is disposed in a top portion of the core 20 to seal the top portion thereof.

Further, the coring apparatus includes a screw 40 which is disposed over the core 20 and the screw 40 rotates and moves upwardly when the external tube 10 and the core 20 are inserted into the seabed.

Here, the coring apparatus includes a stopper moving part 50 having a stopper moving shaft 51 which connects the screw 40 with the stopper 30 and moves the stopper 30 downwardly with respect to the core 20 in response to the rotation of the screw 40 when the external tube 10 and the core 20 are pulled up, thereby sealing the top portion of the core 20.

The stopper moving shaft 51 as described above may have a helical shape (bolt shape) for helical coupling so as to move at the time of the rotation.

Further, the stopper moving part 50 is provided with a nut part 52 which is coupled with a helical part of the stopper moving shaft 51.

The foregoing structure has a structure in which when the external tube 10 and the core 20 are pulled up, the screw 40 rotates and the stopper moving shaft 51 moves downwardly with respect to the core 20 by rotating the stopper moving shaft 51 simultaneously with the rotation of the screw 40, such that the stopper 30 moves downwardly with respect to the core 20 to completely seal the top portion of the core 20.

Therefore, the occurrence of the phenomenon in which the marine sediments in the core 20 pours down from the core 20 and the disturbance phenomenon in which the marine sediments are mixed in the core 20 is prevented.

According to the exemplary embodiment of the present invention, when the external tube 10 and the core descend toward the seabed for performing the coring operation, the screw 40 may be rotated in an opposite direction to a rotation direction of the screw 40 when the external tube and the core move upwardly.

The structure generates a propulsive force by the rotation of the screw 40 to more rapidly move the external tube 10 and the core 20 toward the seabed, such that the external tube 10 and the core 20 are deeply inserted into the seabed.

As a result, no matter how relatively light the weight of the coring apparatus is, the propulsive force is generated by the rotation of the screw 40, such that the external tube 10 and the core 20 may be deeply inserted into the seabed by this propulsion.

According to the exemplary embodiment of the present invention, the stopper moving shaft 51 is preferably implemented so as not to move even though the screw 40 rotates when the external tube 10 and the core 20 descend. For this reason, it is possible to make a length of the stopper moving shaft 51 short, and the like.

In particular, when the stopper moving shaft 51 has a bolt shape having a helical curve, the stopper moving shaft 51 is strongly tightened at an end portion of the helical curve to cause the phenomenon in which the screw 40 does not smoothly rotate even though the screw 40 is applied with a force rotating in an opposite direction. Even though the screw rotates when the core 20 descends, the phenomenon may be prevented by preventing the stopper moving shaft 51 from moving.

Therefore, when the external tube 10 and the core 20 descend, the stopper moving shaft 51 is implemented so as not to move even though the screw 40 rotates.

To this end, a hanger is disposed at a connection part between the stopper moving shaft 51 and the screw 40, when the external tube 10 and the core 20 are pulled up, a torque of the screw is delivered to the stopper moving shaft 51 by the hanger to rotate the stopper moving shaft 51 together, and when the screw 40 rotates in an opposite direction (when the external tube 10 and the core 20 descend), there is no portion to which the hanger is hanged, such that only the screw 40 may rotate (not illustrated).

Only when the screw rotates in any one direction by the hanger, the structure in which the torque is delivered to the shaft may be widely applied to a box spanner, and the like, which is a tool loosening or tightening a bolt and a nut.

As set forth above, according to the coring apparatus in accordance with the exemplary embodiments of the present invention, the screw disposed over the top portion of the core rotates by the force caused by upward movement of the coring apparatus at the time of pulling up the coring apparatus after the coring apparatus performs the coring operation. This action moves the stopper and allows the stopper to seal the top portion of the core. This prevents the phenomenon in which the marine sediments filled in the core pour down from the core to be lost and in which the marine sediments in the core are disturbed.

Further, according to the exemplary embodiments of the present invention, when the external tube and the core descend toward the seabed for performing the coring operation, the screw rotates in one direction and when the external tube and the core move upwardly, the screw rotates in an opposite direction to make the external tube and the core more rapidly move toward the seabed, such that the external tube and the core are inserted with more force into the seabed, thereby better performing the coring operation.

The present invention is not limited to the above-mentioned exemplary embodiments but may be variously applied, and may be variously modified by those skilled in the art to which the present invention pertains without departing from the gist of the present invention claimed in the claims.

What is claimed is:

1. A sediment coring apparatus for preventing a loss and a disturbance of samples in a core, comprising:

a core filled with marine sediments;

an external tube inserted into a seabed for performing a coring operation;

the core which is disposed in the external tube and has the marine sediments filled from a bottom portion thereof by being inserted into the seabed at the same time when the external tube is inserted into the seabed;

a stopper which is disposed to be adhered to a top portion of the core to seal the top portion of the core;

a screw which is disposed over the core and rotates when the external tube and the core inserted into the seabed move upward in the state in which the external tube and the core contact seawater when the external tube and the core are pulled up; and a stopper moving part having a stopper moving shaft which connects the screw with the stopper to move the stopper toward the core in response to the rotation of the screw when the external tube and the core are pulled up so as to seal the top portion of the core.

2. The sediment coring apparatus of claim 1, wherein when the external tube and the core descend toward the seabed for performing the coring operation, the screw rotates and when the external tube and the core move upwardly, the screw rotates in an opposite direction to the rotation direction of the screw to make the external tube and the core more rapidly move toward the seabed.

3. The sediment coring apparatus of claim 1, wherein the stopper moving shaft has a helical shape for helical coupling so as to move at the time of the rotation and when the external tube and the core descend and the screw rotates, the stopper moving shaft does not move.

4. The sediment coring apparatus of claim 2, wherein the stopper moving shaft has a helical shape for helical coupling so as to move at the time of the rotation and when the external tube and the core descend and the screw rotates, the stopper moving shaft does not move.

* * * * *